US007737916B2

(12) United States Patent
Choi

(10) Patent No.: US 7,737,916 B2
(45) Date of Patent: Jun. 15, 2010

(54) PLASMA DISPLAY APPARATUS AND DRIVING METHOD THEREOF TO YIELD A STABLE ADDRESS DISCHARGE

(75) Inventor: Jeong Pil Choi, Suwon-si (KR)

(73) Assignee: LG Electronics Inc., Seoul (KR)

( * ) Notice: Subject to any disclaimer, the term of this patent is extended or adjusted under 35 U.S.C. 154(b) by 906 days.

(21) Appl. No.: 11/511,274

(22) Filed: Aug. 29, 2006

(65) Prior Publication Data

US 2007/0046585 A1 Mar. 1, 2007

(30) Foreign Application Priority Data

Aug. 30, 2005 (KR) ..... 10-2005-0080401
Sep. 15, 2005 (KR) ..... 10-2005-0086324

(51) Int. Cl.
*G09G 3/28* (2006.01)

(52) U.S. Cl. ..... 345/60; 345/68

(58) Field of Classification Search ..... 345/60, 345/68

See application file for complete search history.

(56) References Cited

U.S. PATENT DOCUMENTS

| | | | | |
|---|---|---|---|---|
| 6,538,627 | B1 * | 3/2003 | Whang et al. | 345/60 |
| 2002/0097200 | A1 * | 7/2002 | Setoguchi et al. | 345/60 |
| 2003/0030599 | A1 * | 2/2003 | Kim | 345/60 |
| 2004/0246206 | A1 * | 12/2004 | Choi | 345/60 |
| 2005/0052347 | A1 | 3/2005 | Chung et al. | 347/37 |
| 2005/0116895 | A1 * | 6/2005 | Lee et al. | 345/60 |
| 2005/0116900 | A1 * | 6/2005 | Kang et al. | 345/60 |
| 2005/0280024 | A1 | 12/2005 | Kim et al. | 257/146 |

FOREIGN PATENT DOCUMENTS

| | | | |
|---|---|---|---|
| CN | 1366287 | A | 8/2002 |
| EP | 1 227 462 | A2 | 7/2002 |
| EP | 1 533 781 | A2 | 5/2005 |
| KR | 10-2001-0046350 | A | 6/2001 |
| KR | 10-2005-0036623 | A | 4/2005 |

OTHER PUBLICATIONS

European Search Report dated Feb. 5, 2009.
European Search Report dated Mar. 28, 2007.
Korean Office Action dated Aug. 29, 2006.
Chinese Office Action dated Jun. 5, 2009.

* cited by examiner

*Primary Examiner*—Richard Hjerpe
*Assistant Examiner*—Priyank Shah
(74) *Attorney, Agent, or Firm*—KED & Associates, LLP

(57) ABSTRACT

A plasma display apparatus and a method of driving the plasma display apparatus are disclosed. The plasma display apparatus includes a plasma display panel including a plurality of electrodes, a driving pulse controller for outputting a timing control signal and a driver. The driver supplies a set-down pulse to at least one electrode of the plurality of electrodes depending on the timing control signal. The first set-down pulse gradually falls from a first voltage to a second voltage during a first period, is maintained at the second voltage during a second period, and gradually falls from the second voltage to a third voltage during a third period.

19 Claims, 15 Drawing Sheets

PLASMA DISPLAY APPARATUS AND DRIVING METHOD THEREOF TO YIELD A STABLE ADDRESS DISCHARGE

This Nonprovisional application claims priority under 35 U.S.C. §119(a) on Patent Application No. 10-2005-0080401 filed in Korea on Aug. 30, 2005 and 10-2005-0086324 filed in Korea on Sep. 15, 2005 the entire contents of which are hereby incorporated by reference.

BACKGROUND

1. Field

This document relates to a plasma display apparatus.

2. Description of the Related Art

A plasma display apparatus comprises a plasma display panel and a driver for driving the plasma display panel. A plasma display panel comprises a front panel a rear panel and discharge cells partitioned by barrier ribs formed between the front panel and the rear panel. Each of the discharge cells is filled with an inert gas containing a main discharge gas such as neon (Ne), helium (He) and a mixture of Ne and He, and a small amount of xenon (Xe). When a discharge occurs inside the discharge cell by a high frequency voltage supplied to an electrode of the plasma display apparatus, the inert gas generates vacuum ultra-violet rays, which thereby cause phosphors formed between the barrier ribs to emit light, thus displaying an image.

The plasma display apparatus represents gray scale of the image by mapping an image signal for at least one of a plurality of subfields constituting a frame. Each of the subfields is divided into a reset period for initializing all the discharge cells, an address period for selecting cells to be discharged and a sustain period for representing gray scale.

SUMMARY

In an aspect there is provided a plasma display apparatus comprising a plasma display panel comprising a plurality of electrodes, a driving pulse controller for outputting a timing control signal and a driver for supplying a first set-down pulse, which gradually falls from a first voltage to a second voltage during a first period, is maintained at the second voltage during a second period, and gradually falls from the second voltage to a third voltage during a third period, to at least one electrode of the plurality of electrodes depending on the timing control signal.

In another aspect, there is provided a plasma display apparatus comprising a plasma display panel comprising a plurality of electrodes, a driving pulse controller for outputting a timing control signal and a driver for supplying a first set-down pulse, which gradually falls from a first voltage to a second voltage during a first period, is maintained at the second voltage during a second period, and gradually falls from the second voltage to a third voltage during a third period, to at least one electrode of the plurality of electrodes depending on the timing control signal and for supplying a scan pulse to at least one electrode of the remaining electrodes except at least one electrode of the plurality of electrodes during the second period.

In still another aspect there is provided a method of driving a plasma display apparatus comprising a plurality of electrodes, comprising gradually falling a voltage of at least one electrode of the plurality of electrodes from a first voltage to a second voltage during a first period of a set-down period, maintaining a voltage of at least one electrode at the second voltage during a second period of the set-down period, and gradually falling a voltage of at least one electrode from the second voltage to a third voltage during a third period of the set-down period.

BRIEF DESCRIPTION OF THE DRAWINGS

The embodiment of the invention will be described in detail with reference to the following drawings in which like numerals refer to like elements.

DETAILED DESCRIPTION OF PREFERRED EMBODIMENTS

Figure 1:
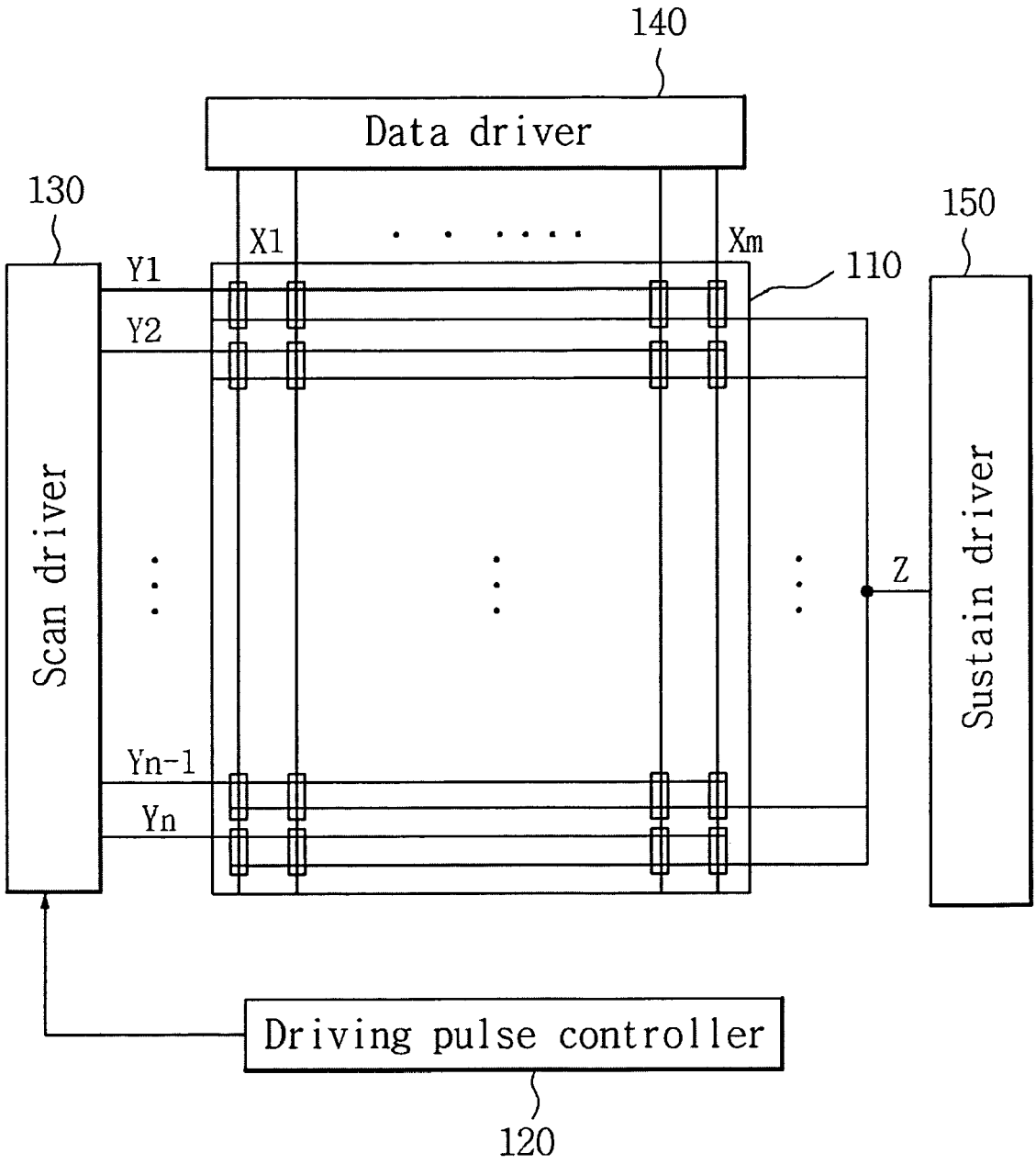
FIG. 1 illustrates a plasma display apparatus according to embodiments.

Embodiments of the present invention will be described in a more detailed manner with reference to the drawings.

A plasma display apparatus comprises a plasma display panel comprising a plurality of electrodes, a driving pulse controller for outputting a timing control signal, and a driver for supplying a first set-down pulse, which gradually falls from a first voltage to a second voltage during a first period, is maintained at the second voltage during a second period, and gradually falls from the second voltage to a third voltage during a third period, to at least one electrode of the plurality of electrodes depending on the timing control signal.

The driver may sequentially supply a scan pulse to at least two successively disposed electrodes of the plurality of electrodes.

The driver sequentially may supply a scan pulse to either odd-numbered electrodes or even-numbered electrodes of the plurality of electrodes.

The driver may supply a second set-own pulse, which gradually falls from a fourth voltage to a fifth voltage during the first period, is maintained at the fifth voltage during the second period, and gradually falls from the fifth voltage to a sixth voltage during the third period, to at least one electrode of the remaining electrodes except at least one electrode of the plurality of electrodes. The number of electrodes supplied with the second set-down pulse may be equal to the number of electrodes supplied with the first set-own pulse.

The driver may supply a first set-down pulse, which gradually falls from a first voltage to a second voltage during a first period, is maintained at the second voltage during a second period, and gradually falls from the second voltage to a third voltage during a third period, to at least one electrode of the plurality of electrodes in each of two different subfields. The duration of the second period of one subfield of the two different subfields is different from the duration of the second period of the remaining subfield.

The driver may supply a second set-down pulse, which gradually falls from a fourth voltage to a fifth voltage during the first period, is maintained at the fifth voltage during the second period, and gradually falls from the fifth voltage to a sixth voltage during the third period, to at least one electrode of the remaining electrodes except at least one electrode of the plurality of electrodes. The number of electrodes supplied with the second set-down pulse may be different from the number of electrodes supplied with the first set-down pulse.

A magnitude of a slope of the voltage supplied during the first period may be substantially equal to a magnitude of a slope of the voltage supplied during the third period.

A magnitude of a slope of the voltage supplied during the first period may be different from a magnitude of a slope of the voltage supplied during the third period.

The first voltage may be more than a ground level voltage, and may be equal to or less than a sustain voltage.

The second voltage may be more than the third voltage, and may be equal to or less than a ground level voltage.

The third voltage may be equal to or more than a lowest voltage of a scan pulse supplied to the plurality of electrodes during an address period.

The driver may supply a second set-down pulse, which gradually falls from a fourth voltage to a fifth voltage during the first period, is maintained at the fifth voltage during the second period, and gradually falls from the fifth voltage to a sixth voltage during the third period, to at least one electrode of the remaining electrodes except at least one electrode of the plurality of electrodes. The duration of a period during which the first set-down pulse is maintained at the second voltage may be different from the duration of a period during which the second set-down pulse is maintained at the fifth voltage.

The driver may supply the first set-down pulse to a first electrode of the plurality of electrodes. The driver may supply a second set-down pulse, which gradually falls from a fourth voltage to a fifth voltage during the first period, is maintained at the fifth voltage during the second period, and gradually falls from the fifth voltage to a sixth voltage during the third period, to a second electrode of the plurality of electrodes. The driver may supply a scan pulse to the first electrode, and may supply a scan pulse to the second electrode subsequent to a pause period.

The driver may supply the second set-down pulse so that the pause period may overlap a portion of the third period.

The pause period may range from 1 us to 100 us.

The driver may supply a set-down pulse gradually falling from a seventh voltage to an eighth voltage to at least one electrode of the remaining electrodes except at least one electrode of the plurality of electrodes.

The driver may supply the first set-down pulse to a first electrode of the plurality of electrodes, and may supply a second set-down pulse to a second electrode of the plurality of electrodes. After supplying a scan pulse to the first electrode, the driver may supply a scan pulse to the second electrode. The second set-down pulse may gradually fall from a fourth voltage to a fifth voltage during the first period, may be maintained at the fifth voltage during the second period, and may gradually fall from the fifth voltage to a sixth voltage during the third period. The duration of the second period during which the second set-down pulse is maintained at the fifth voltage may be more than the duration of the second period during which the first set-down pulse is maintained at the second voltage.

A plasma display apparatus comprises a plasma display panel comprising a plurality of electrodes, a driving pulse controller for outputting a timing control signal, and a driver for supplying a first set-down pulse, which gradually falls from a first voltage to a second voltage during a first period, is maintained at the second voltage during a second period, and gradually falls from the second voltage to a third voltage during a third period, to at least one electrode of the plurality of electrodes depending on the timing control signal, and for supplying a scan pulse to at least one electrode of the remaining electrodes except at least one electrode of the plurality of electrodes during the second period.

After supplying the scan pulse, the driver may supply at least one of a plurality of sustain pulses to at least one electrode of the remaining electrodes except at least one electrode of the plurality of electrodes during the second period.

A method of driving a plasma display apparatus comprising a plurality of electrodes, comprises gradually falling a voltage of at least one electrode of the plurality of electrodes from a first voltage to a second voltage during a first period of a set-down period, maintaining a voltage of at least one electrode at the second voltage during a second period of the set-down period, and gradually falling a voltage of at least one electrode from the second voltage to a third voltage during a third period of the set-down period.

Hereinafter, exemplary embodiments of the present invention will be described in detail with reference to the attached drawings.

FIG. 1 illustrates a plasma display apparatus according to embodiments. As illustrated in FIG. 1, the plasma display apparatus according to the embodiments comprises a plasma display panel 110, a driving pulse controller 120, a scan driver 130, a data driver 140 and a sustain driver 150.

The plasma display panel 110 comprises scan electrodes Y1 to Yn, sustain electrodes Z and address electrodes X1 to Xm. A driving pulse is supplied to at least one of the scan electrodes Y1 to Yn, the sustain electrodes Z and the address electrodes X1 to Xm, thereby displaying an image corresponding to an image signal on the plasma display panel 110.

The driving pulse controller 120 outputs a timing control signal for controlling the scan driver 130.

The scan driver 130 receives the timing control signal from the driving pulse controller 120, and then supplies a setup pulse and a set-down pulse for uniformalizing wall charges of discharge cells during a reset period to the scan electrodes Y1 to Yn. The scan driver 130 supplies a set-down pulse, which gradually falls from a first voltage to a second voltage during a first period, is maintained at the second voltage during a second period, and gradually falls from the second voltage to a third voltage during a third period, to at least one of the plurality of scan electrodes Y1 to Yn depending on the timing control signal. The scan driver 130 supplies a scan pulse during an address period and a sustain pulse during a sustain period to the scan electrodes Y1 to Yn. An operation of the scan driver 130 will be described in detail later with reference to the attached drawings.

The data driver 140 supplies a data pulse corresponding to the image signal in synchronization with the scan pulse to the address electrodes X1 to Xm.

The sustain driver 150 supplies a sustain pulse during the sustain period to the sustain electrodes Z. The scan driver 130 and the sustain driver 150 alternately supply the sustain pulse during the sustain period.

Figure 2:
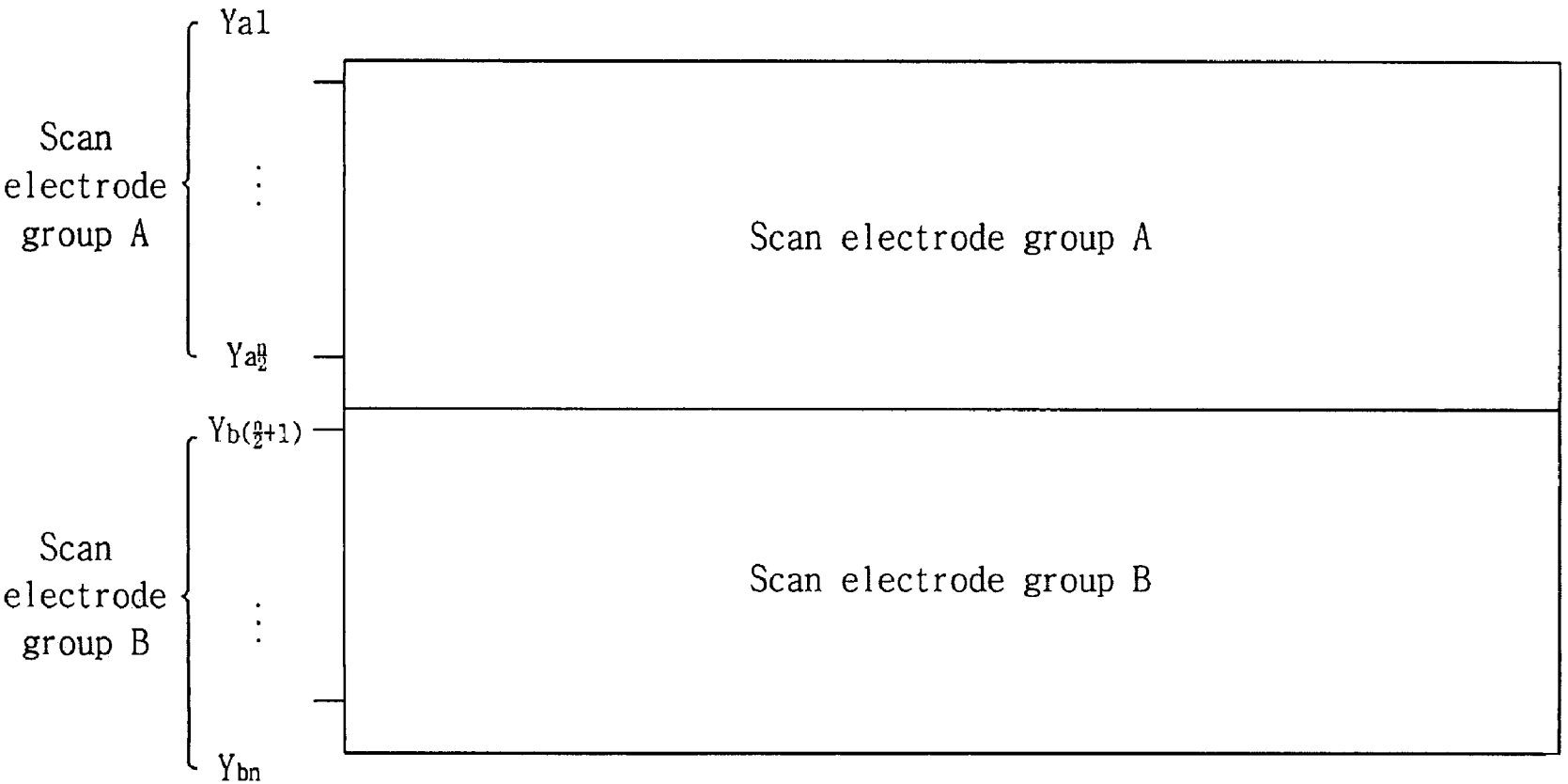
FIGS. 2 to 4 illustrate a method of driving the plasma display apparatus according to the embodiments.

FIG. 2 illustrates a method of driving the plasma display apparatus according to the embodiments in which the plurality of scan electrodes of the plasma display panel are divided into two scan electrode groups.

Figure 3:
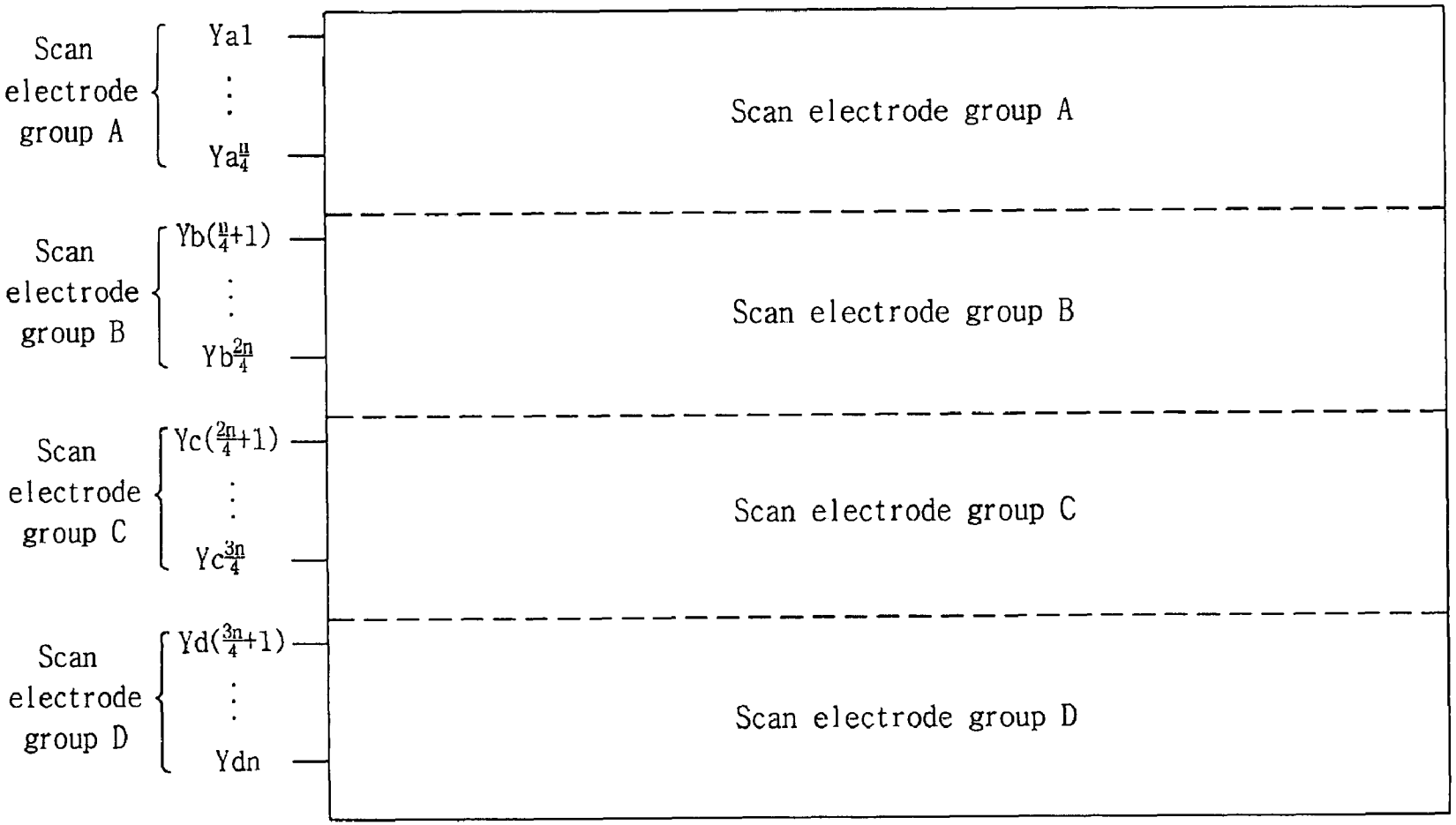
Figure 4:
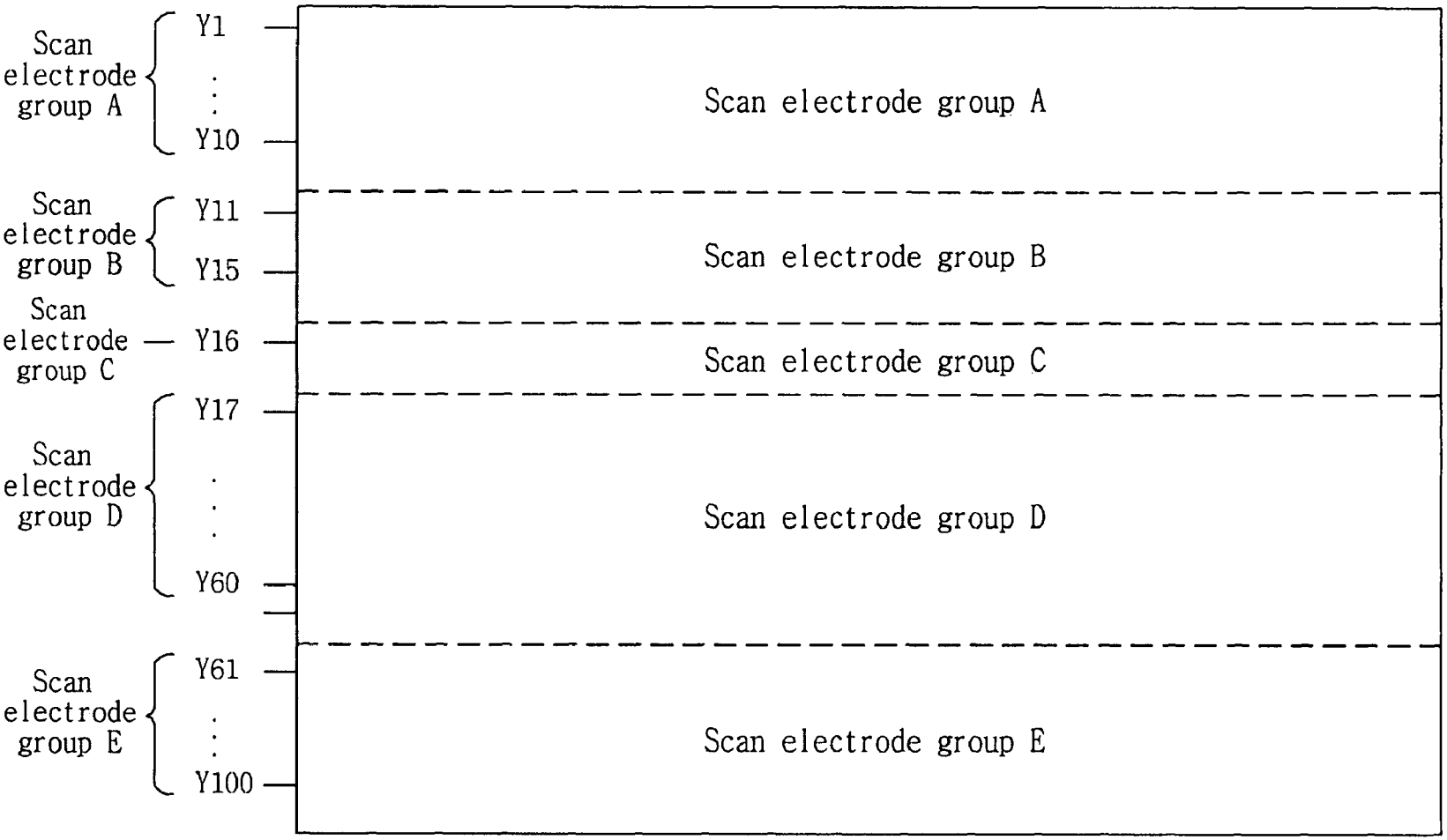

FIGS. 2 to 4 illustrate a method of driving the plasma display apparatus acceding to the embodiments.

For example, a scan electrode group A includes a scan electrode Ya1 to a scan electrode Ya(n/2), and a scan electrode group B includes a scan electrode Yb((n/2)+1)) to a scan electrode Yb(n). The scan electrodes of each of the two scan electrode groups A and B are successively disposed The scan driver 130 sequentially supplies the scan pulse.

In FIG. 2, the plurality of scan electrodes are divided into the two scan electrode groups. However, the plurality of scan electrodes may be divided into two or more scan electrode groups.

As illustrated in FIG. 3, the plurality of scan electrodes are divided into four scan electrode groups A, B, C and D. The scan electrode group A includes a scan electrode Ya1 to a scan electrode Ya(n/4), the scan electrode group B includes a scan electrode Yb((n/4)+1)) to a scan electrode Yb((2n)/4), the scan electrode group C includes a scan electrode Yc((2n/4)+1)) to a scan electrode Yc((3n)/4), and the scan electrode group D includes a scan electrode Yd((3n/4)+1)) to a scan electrode Yd(n). The scan electrodes of each of the four scan electrode groups A, B, C and D are successively disposed. The scan driver 130 sequentially supplies the scan pulse.

In FIGS. 2 and 3, each of the scan electrode groups includes an equal number of scan electrodes. However, as illustrated in FIG. 4, each of scan electrode groups may include a different number of scan electrodes. In FIG. 4, the plurality of scan electrodes are divided into five scan electrode groups A, B, C, D and E. The scan electrode group A includes a scan electrode Y1 to a scan electrode Y10, the scan electrode group B includes a scan electrode Y11 to a scan electrode Y15, the scan electrode group C includes as can electrode Y16, the scan electrode group D includes a scan electrode Y17 to a scan electrode Y60, and the scan electrode group E includes a scan electrode Y61 to a scan electrode Y100.

When one scan electrode group includes two or more scan electrodes, the two or more scan electrodes are successively disposed. Further, the scan driver 130 sequentially supplies the scan pulse to the two or more scan electrodes of one scan electrode group.

Figure 5A:
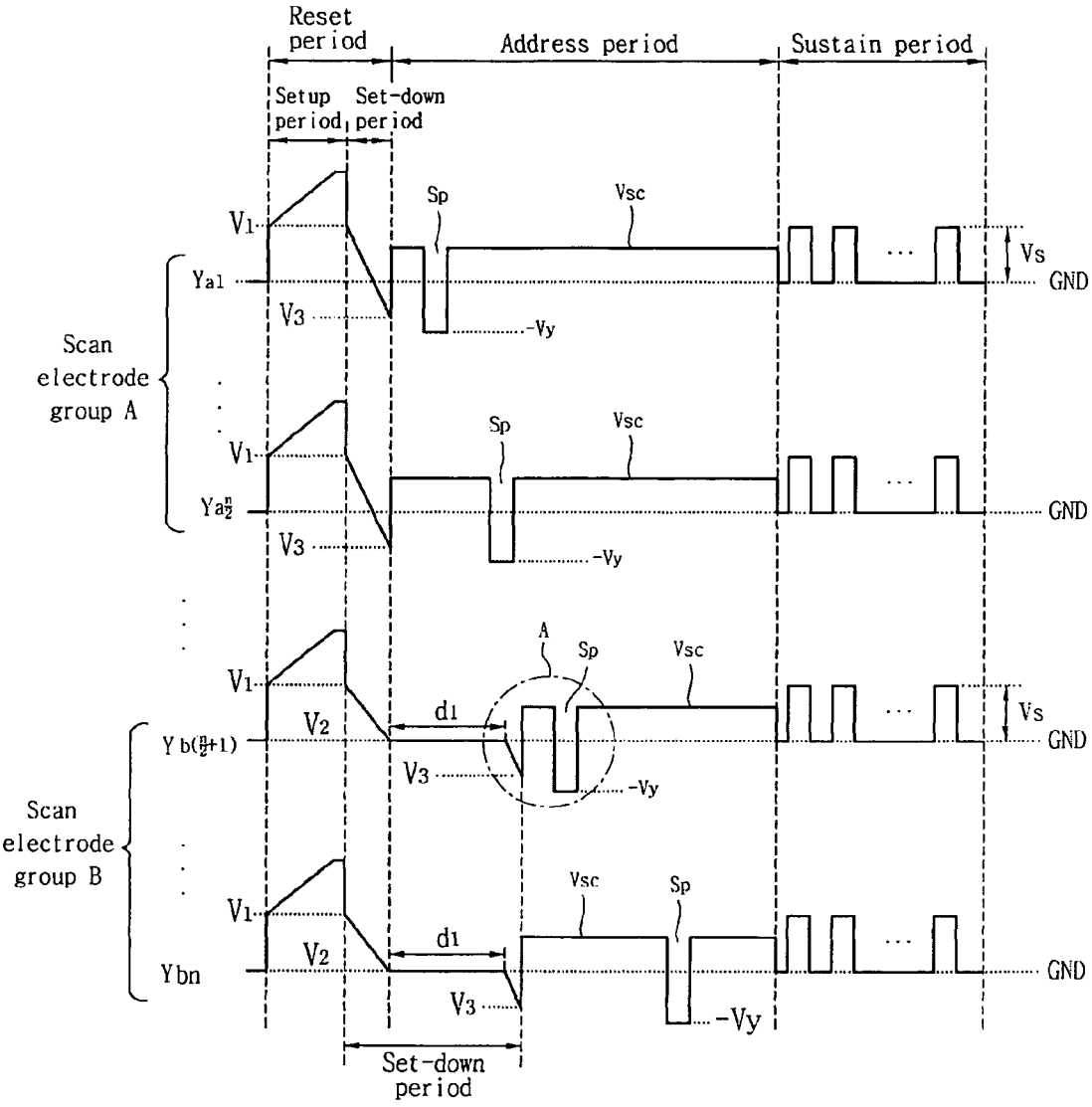
FIGS. 5*a* and 5*b* illustrate a method of driving the plasma display apparatus according to a first embodiment.
Figure 5B:
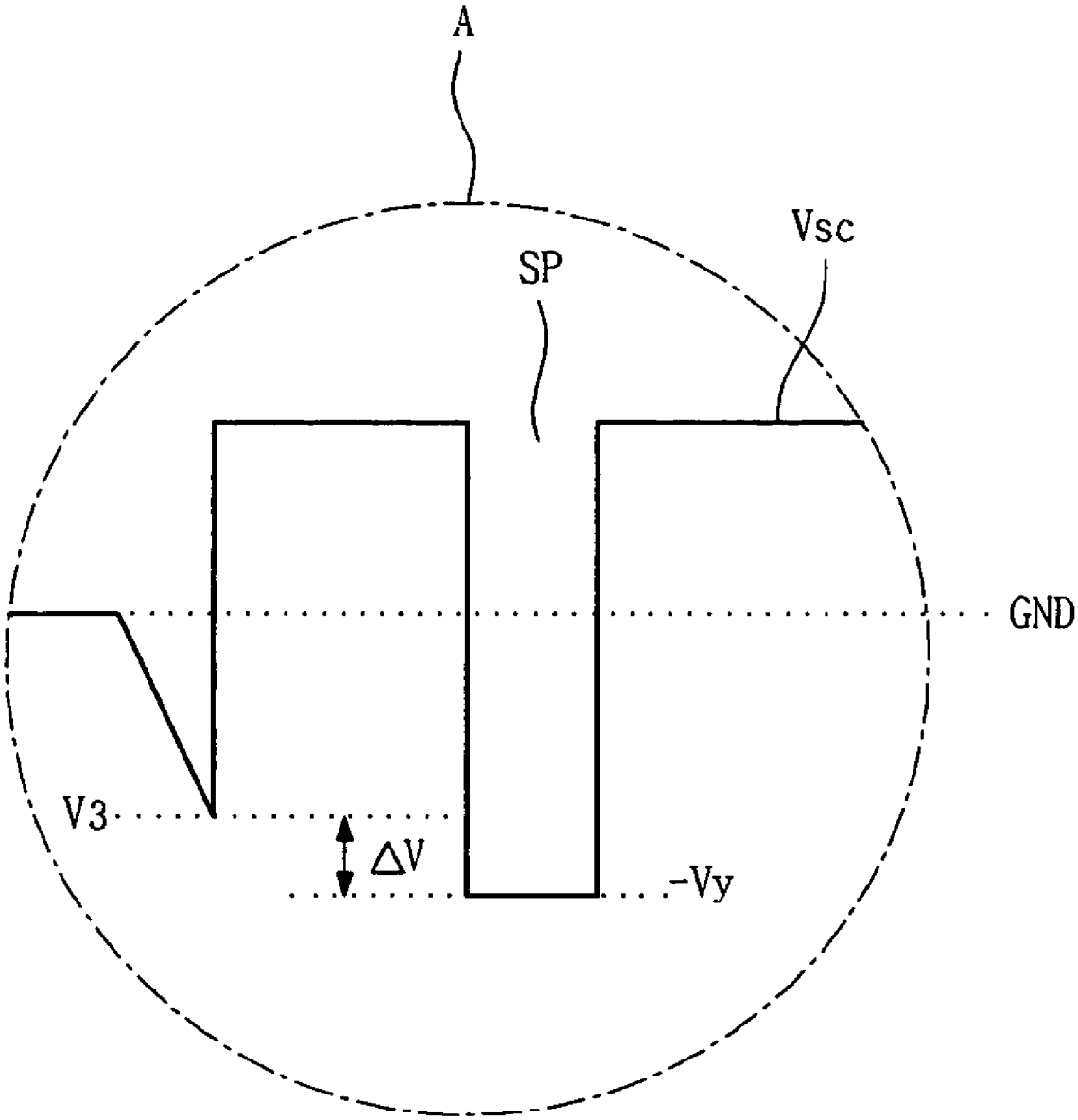

FIGS. 5*a* and 5*b* illustrate a method of driving the plasma display apparatus according to a first embodiment.

As illustrated in FIG. 5*a*, the scan driver 130 supplies a set-down pulse gradually falling from a first voltage V1 to a second voltage V3 to the scan electrodes Ya1 to Ya(n/2) of the scan electrode group A during the reset period. The scan driver 130 supplies a set-down pulse, which gradually falls from a first voltage V1 to a second voltage V2 during a first period of the reset period, is maintained at the second voltage V2 during a second period d1 of the reset period, and gradually falls from the second voltage V2 to a third voltage V3 during a third period of the reset period, to the scan electrodes Yb((n/2)+1) to Ybn of the scan electrode group B.

The second voltage V2 is substantially equal to a ground level voltage GND. The first voltage V1 is more than the ground level voltage GND, and is equal to or less than a sustain voltage Vs. When the first voltage V1 is equal to the sustain voltage Vs, the configuration of the scan driver 130 can be simple. The sustain voltage Vs is a voltage for forming the sustain pulse during the sustain period. A magnitude of a slope of the voltage supplied during the first period of the reset period may be substantially equal to a magnitude of a slope of the voltage supplied during the third period of the reset period. When the magnitude of the slope of the voltage supplied during the first period is substantially equal to the magnitude of the slope of the voltage supplied during the third period, the driving pulse controller 120 easily controls the scan driver 130.

The magnitude of the slope of the voltage supplied during the first period of the reset period may be different from the magnitude of the slope of the voltage supplied during the third period of the reset period. The magnitude of the slope of the voltage supplied during the first period may be more than the magnitude of the slope of the voltage supplied during the third period. When the magnitude of the slope of the voltage supplied during the first period is more than the magnitude of the slope of the voltage supplied during the third period, the wall charges within the discharge cells are erased rapidly.

The second voltage V2 supplied during the second period d1 of the reset period temporarily stops the generation of a set-down discharge for erasing a predetermined amount of wall charges within the discharge cells. Accordingly, after performing the set-down discharge, the supply time of a scan bias voltage Vsc to the scan electrode group B decreases. Although the scanning of the scan electrode group B is later than the scanning of the scan electrode group A, the coupling time of the wall charges and space charges accumulated on the scan electrode group B after performing the set-down discharge decreases, thereby stably generating an address discharge.

When the duration of the maintaining period (i.e., the second period d1) of the second voltage V2 supplied to each of the scan electrodes Yb((n/2)+1) to Ybn of the scan electrode group B is equal to one another, the driving pulse controller 120 easily controls the scan driver 130.

FIG. 5*b* illustrates a relationship between the voltage supplied during the third period of the reset period and the voltage supplied during the second period of the reset period. As illustrated in FIG. 5*b*, the third voltage V3 is more than a scan voltage −Vy of a scan pulse SP supplied to the scan electrode Y during the address period. Accordingly, a voltage difference ΔV occurs between the third voltage V3 and the scan voltage −Vy. When the third voltage V3 is more than the scan voltage −Vy, the scan pulse SP supplied to the scan electrode Y and the data pulse supplied to the address electrode X during the address period generate strongly an address discharge.

Figure 6A:
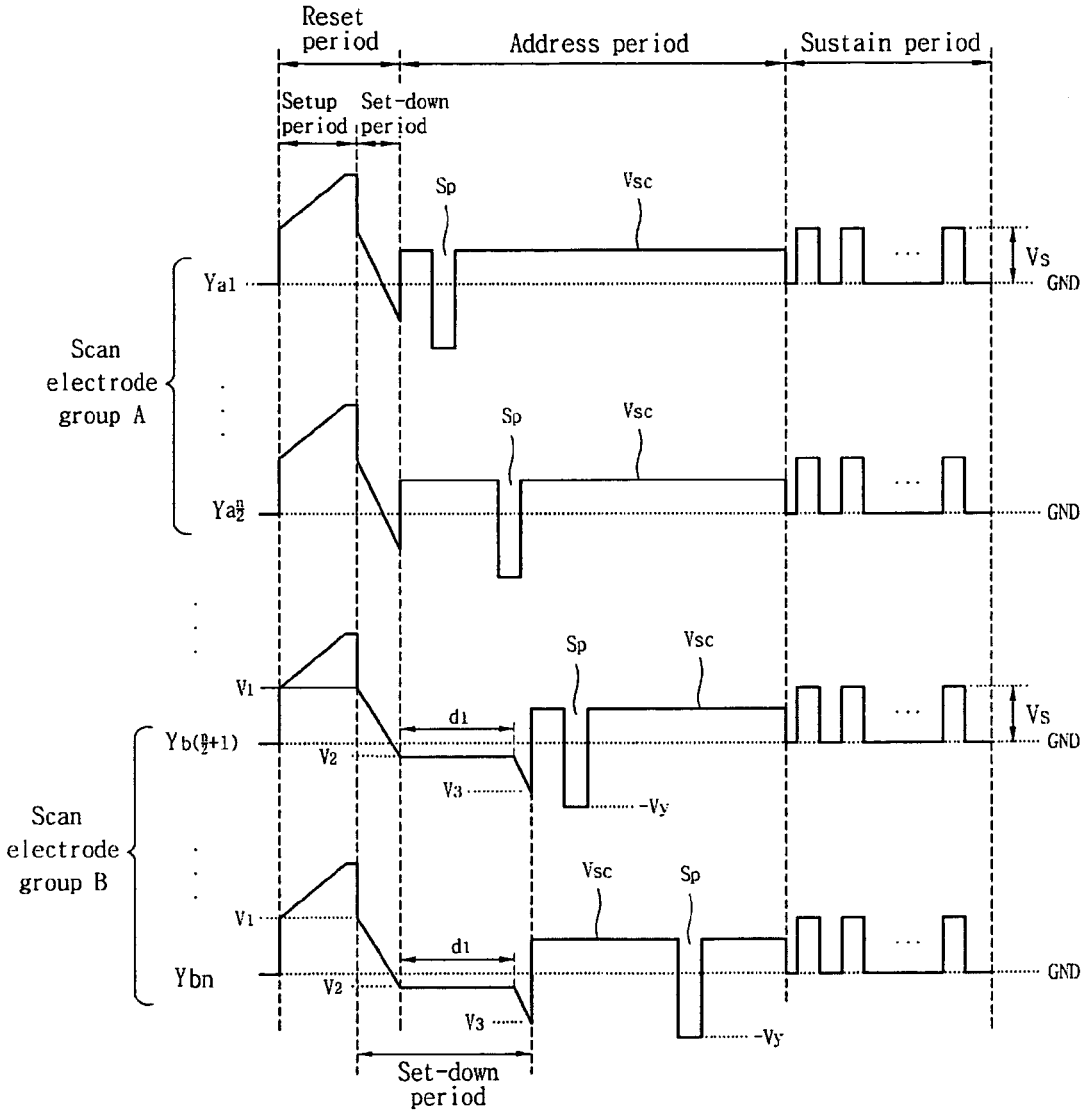
FIGS. 6*a* and 6*b* illustrate a method of driving a plasma display apparatus according to a second embodiment.
Figure 6B:
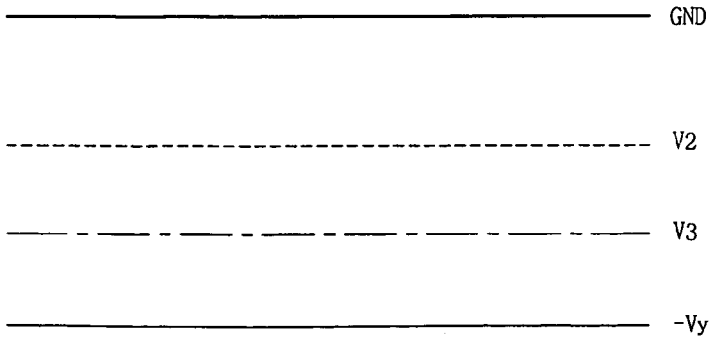

The second voltage V2 supplied during the second period d1 of the reset period, as illustrated in FIGS. 5*a* and 5*b*, may be the ground level voltage. However, as illustrated in FIGS. 6*a* and 6*b*, the second voltage V2 may be a negative voltage level. The second voltage V2 may be more than the third voltage V3, and may be equal to or less than the ground level voltage. When the second voltage V2 is more than the ground level voltage, the duration of the third period of the reset period excessively increases.

Figure 7A:
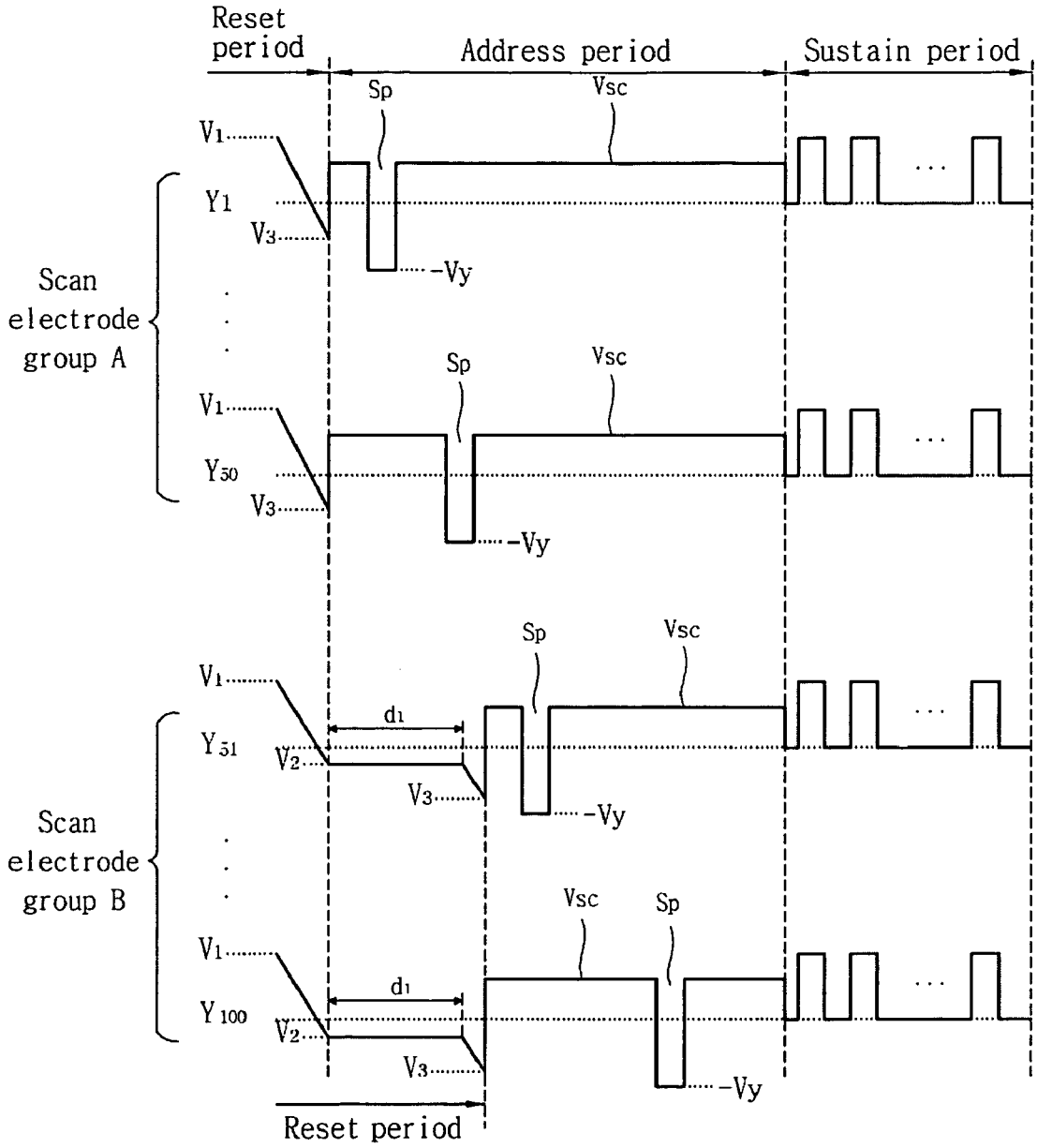
FIGS. 7*a* and 7*b* illustrate a method of driving a plasma display apparatus according to a third embodiment.
Figure 7B:
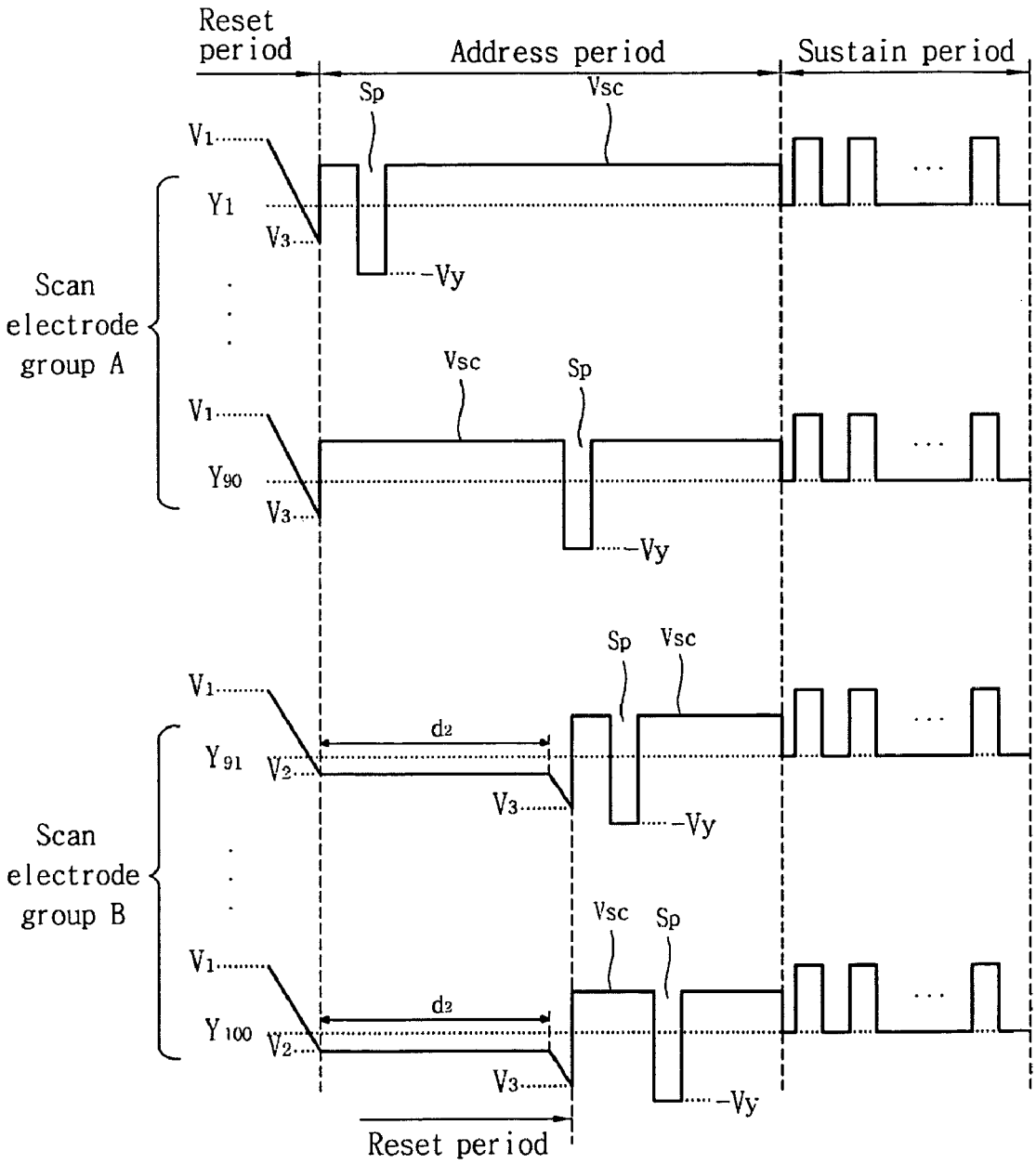

FIGS. 7*a* and 7*b* illustrate a method of driving a plasma display apparatus according to a third embodiment.

As illustrated in FIG. 7*a*, a total of 100 scan electrodes are divided into a scan electrode group A including scan electrodes Y1 to Y50 and a scan electrode group B including scan electrodes Y51 to Y100. The scanning of the scan electrode group B is later than the scanning of the scan electrode group A. A second voltage V2 is supplied to the scan electrode group B during a second period d1 of the reset period. On the other hand, as illustrated in FIG. 7*b*, a total of 100 scan electrodes are divided into a scan electrode group A including scan electrodes Y1 to Y90 and a scan electrode group B including scan electrodes Y91 to Y100. The scanning of the scan electrode group B is later than the scanning of the scan electrode group A. A second voltage V2 is supplied to the scan electrode group B during a second period d2 of the reset period. The duration of the second period d1 of FIG. 7*a* is less than the duration of the second period d2 of FIG. 7*b*. In other words, the number of scan electrodes of a scan electrode group, which is scanned earlier than another scan electrode group, is proportional to the duration of the supply period (i.e., the second period) of the second voltage to scan electrodes of another scan electrode group. Accordingly, when generating an address discharge in another scan electrode group scanned later, the amount of wall charges contributing in the address discharge is sufficient, thereby stably generating the address discharge.

Figure 8:
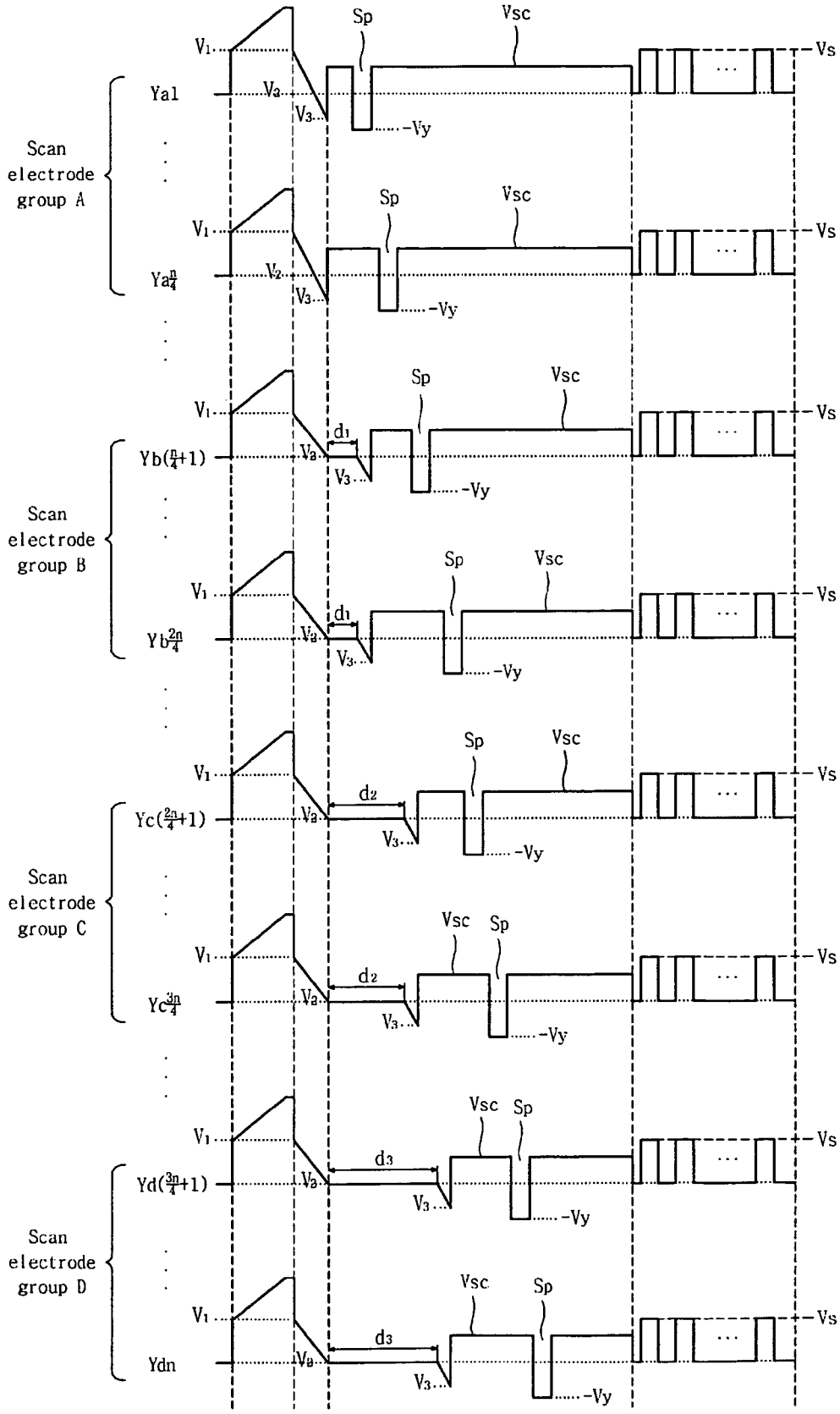
FIG. 8 illustrates a method of driving a plasma display apparatus according to a fourth embodiment.

FIG. 8 illustrates a method of driving a plasma display apparatus according to a fourth embodiment. As illustrated in FIG. 8, the scan driver 130 supplies a second voltage V2 to scan electrodes Ya1 to Ya(n/4) of a scan electrode group A, scan electrodes Yb(n/4)+1 to Yb(2n/4) of a scan electrode group B, scan electrodes Yc(2n/4)+1 to Yc(3n/4) of a scan electrode group C and scan electrodes Yd(3n/4)+1 to Ydn of a scan electrode group D during second periods having different durations.

In the scan electrode group A which is scanned earliest in all the scan electrode groups, the second period of the reset period does not exist. In the scan electrode group B which is scanned later than the scan electrode group A, the second period of the reset period is indicated by d1. In the scan electrode group C which is scanned later than the scan electrode group B, the second period of the reset period is indicated by d2. In the scan electrode group D which is scanned later than the scan electrode group C, the second period of the reset period is indicated by d3. In other words, the decrease amount of wall charges decreases due to an increase in the duration of the temporary stop period (i.e., the second period) of the set-down discharge such that the address discharge occurs stably.

Figure 9:
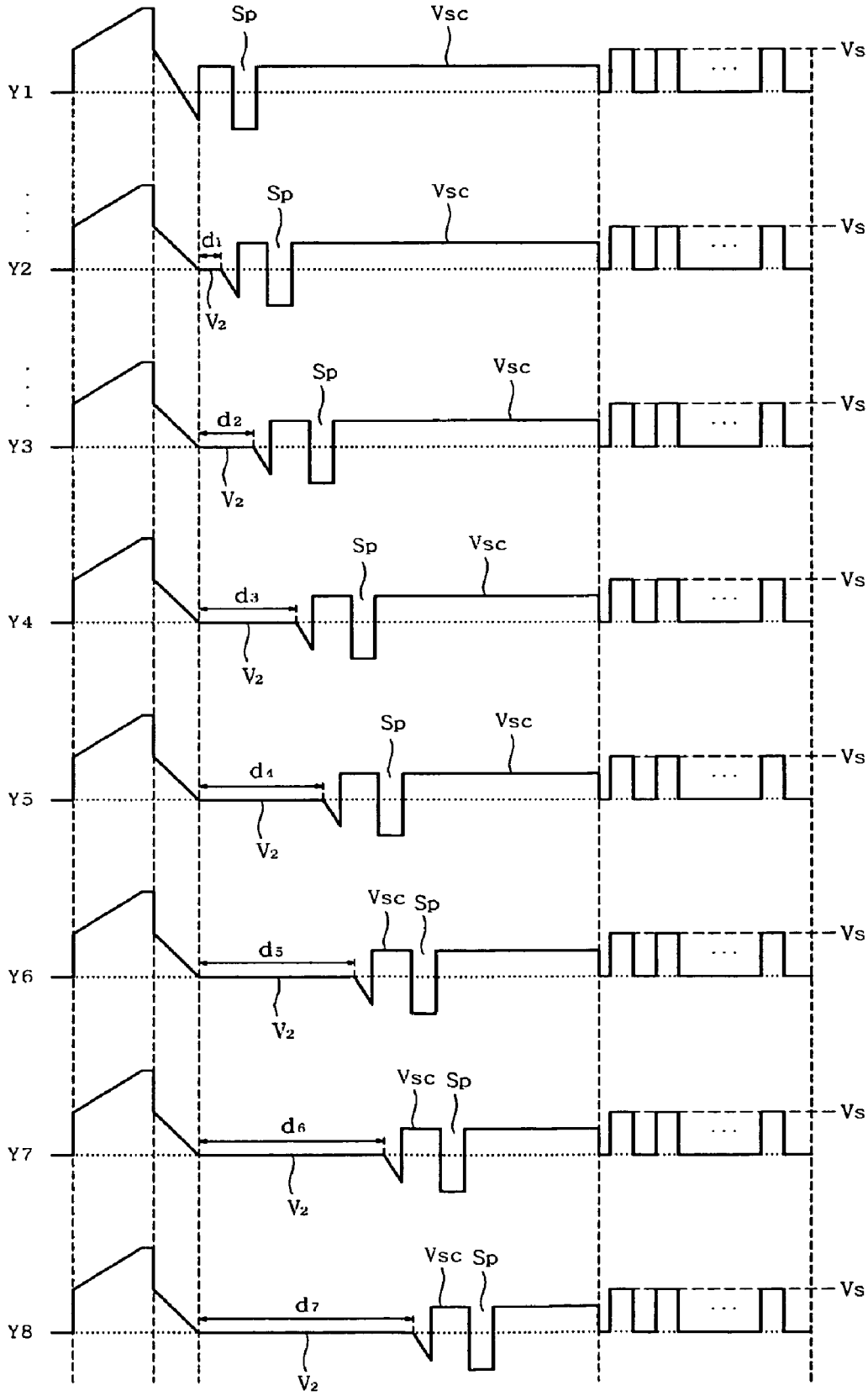
FIG. 9 illustrates a method of driving a plasma display apparatus according to a fifth embodiment.

FIG. 9 illustrates a method of driving a plasma display apparatus according to a fifth embodiment. As illustrated in FIG. 9, the scan driver 130 supplies a second voltage V2 to each of scan electrodes Y1 to Y8 during different second periods 0, d1, d2, d3, d4, d5, d6, d7. A decrease amount of wall charges accumulated on the scan electrode of the later scanning order is small such that a stable address discharge occurs. Further, by controlling the duration of the second period in each of the scan electrodes, a difference between the amount of wall charges accumulated on a scan electrode and the amount of wall charges accumulated on another scan electrode decreases.

Figure 10:
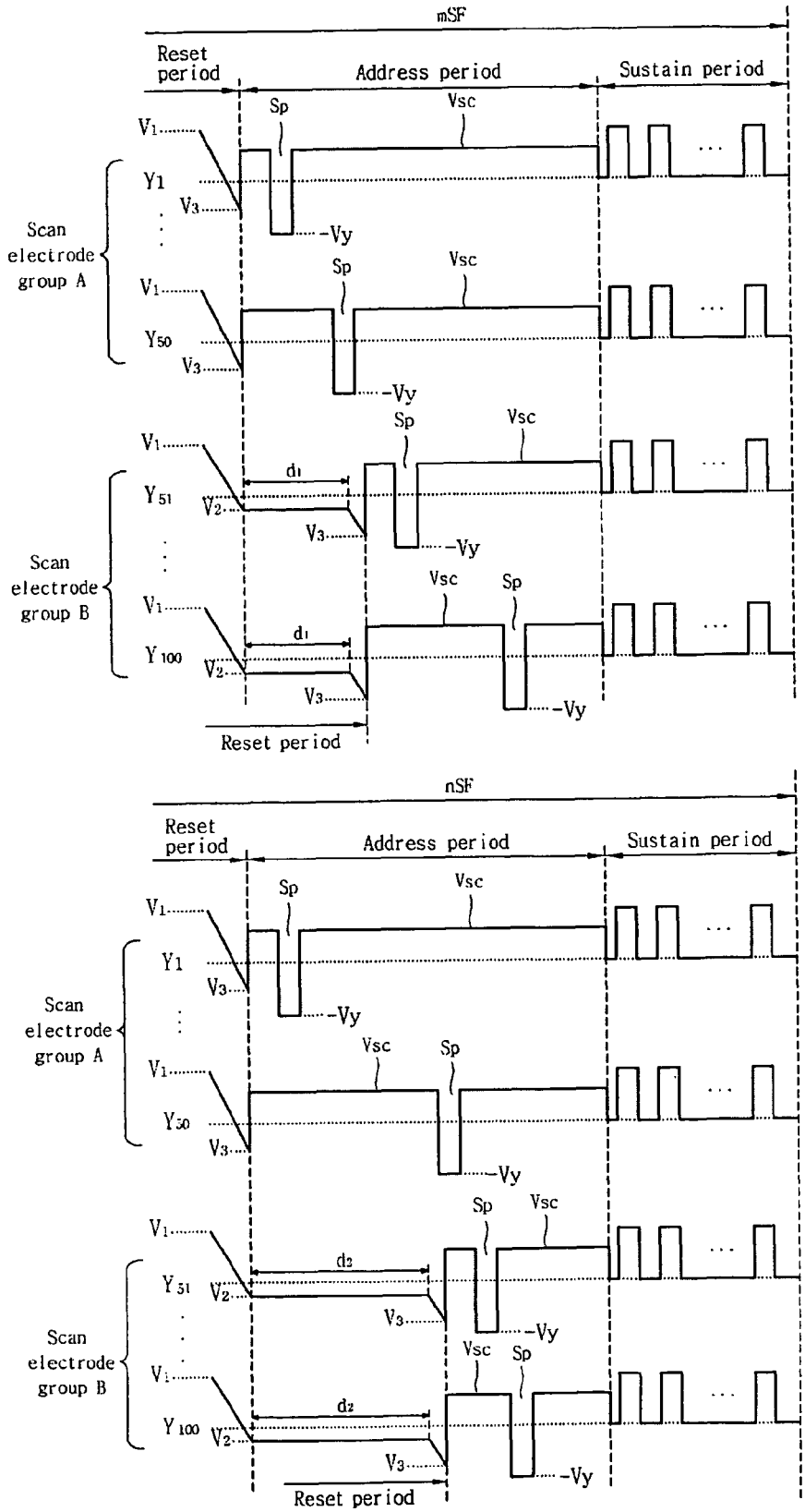
FIG. 10 illustrates a method of driving a plasma display apparatus acceding to a sixth embodiment.

FIG. 10 illustrates a method of driving a plasma display apparatus according to a sixth embodiment. As illustrated in FIG. 10, the duration of a second period during which a second voltage V2 is supplied to scan electrode groups in a subfield mSF may be different from the duration of a second period during which the second voltage V2 is supplied to the same scan electrode groups in a subfield nSF. More specifically, in the subfield mSF, the second voltage V2 may be supplied to scan electrodes Y51 to Y100 of a scan electrode group B during a second period d1. In the subfield nSF, the second voltage V2 may be supplied to the scan electrodes Y51 to Y100 of the scan electrode group B during a second period d2.

Figure 11:
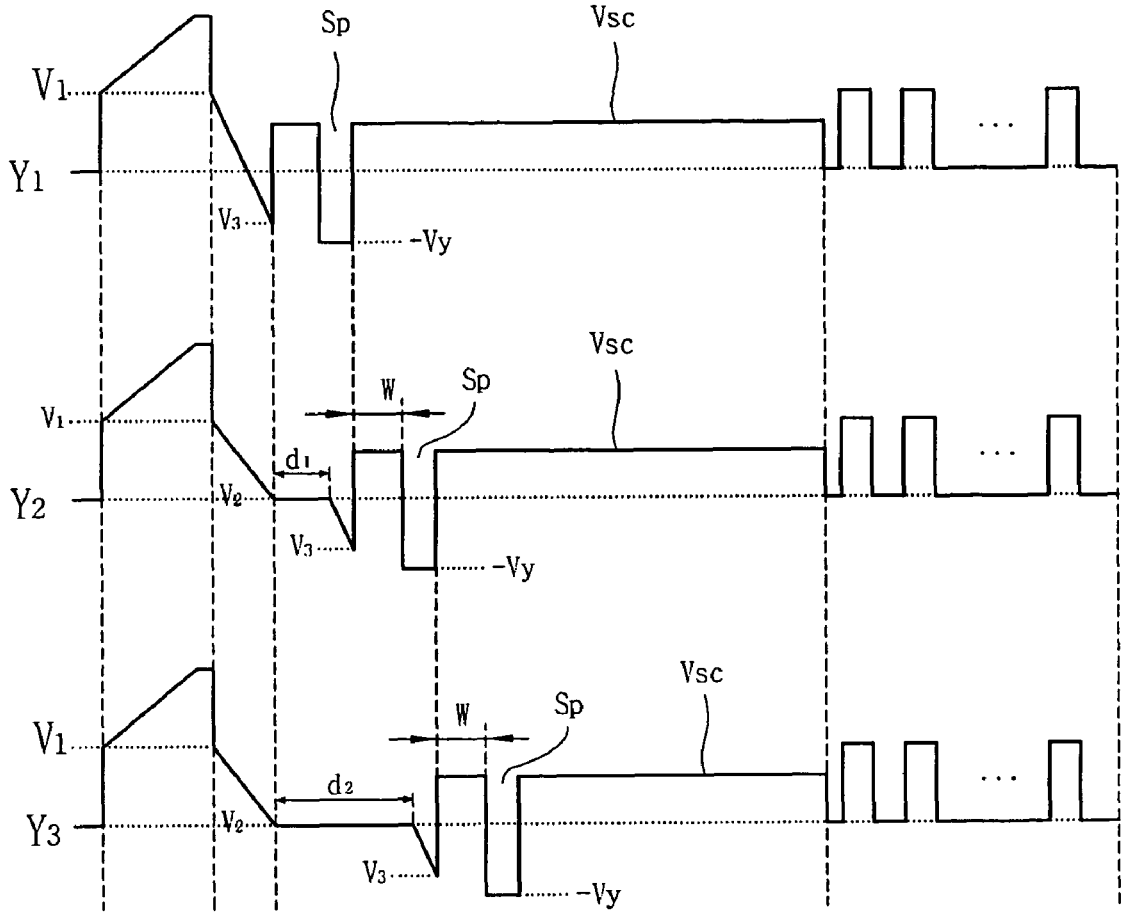
FIG. 11 illustrates a pause period in the method of driving the plasma display apparatus according to the embodiments.

FIG. 11 illustrates a pause period in the method of driving the plasma display apparatus according to the embodiments. As illustrated in FIG. 11, a pause period W exists between a supply end time point of the scan pulse to the scan electrode Y1 and a supply start time point of the scan pulse to the scan electrode Y2. Further, a pause period W exists between a supply end time point of the scan pulse to the scan electrode Y2 and a supply start time point of the scan pulse to the scan electrode Y3. The pause period W of the driving signal supplied to the scan electrode Y1 may overlap a portion of the set-down period of the driving signal supplied to the scan electrode Y2, which is scanned later than the scan electrode Y1. In particular, the pause period W of the driving signal supplied to the scan electrode Y1 may overlap a portion of the second period d1 of the set-down period of the driving signal supplied to the scan electrode Y2, which is scanned later than the scan electrode Y1. The pause period W may range from 1 us to 100 us.

When sequentially supplying the scan pulse to two successively disposed scan electrodes, the pause period existing between the two successively disposed scan electrodes prevents the generation of an erroneous discharge between the two successively disposed scan electrodes.

Figure 12:
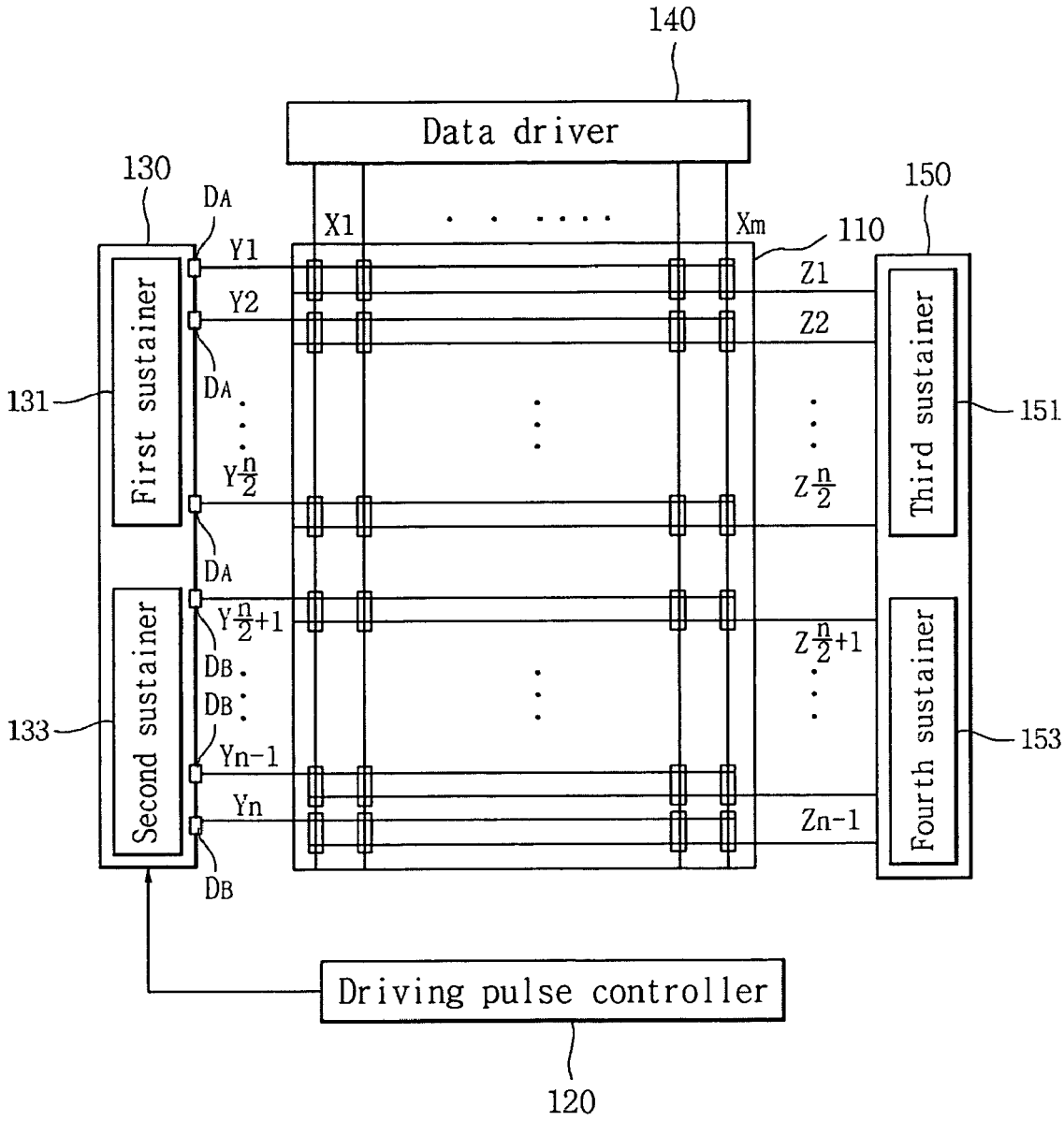
FIG. 12 illustrates the plasma display apparatus according to the second embodiment.

FIG. 12 illustrates the plasma display apparatus according to the second embodiment. As illustrated in FIG. 12, the plasma display apparatus according to the second embodiment comprises a scan driver 130 and a sustain driver 150. The scan driver 130 comprises a first sustainer 131 and a second sustainer 133 for supplying the sustain pulse. The sustain driver 150 comprises a third sustainer 151 and a fourth sustainer 153 for supplying the sustain pulse. The first sustainer 131 supplies the sustain pulse to the scan electrodes Y1 to Y(n/2) of the scan electrode group A of the total of scan electrodes. The second sustainer 133 supplies the sustain pulse to the scan electrodes Y(n/2)+1 to Yn of the scan electrode group B of the total of scan electrodes. The third sustainer 151 supplies the sustain pulse to sustain electrodes Z1 to Z(n/2) of a sustain electrode group A of the total of sustain electrodes. The fourth sustainer 153 supplies the sustain pulse to sustain electrodes Z(n/2)+1 to Zn of a sustain electrode group B of the total of sustain electrodes.

Figure 13:
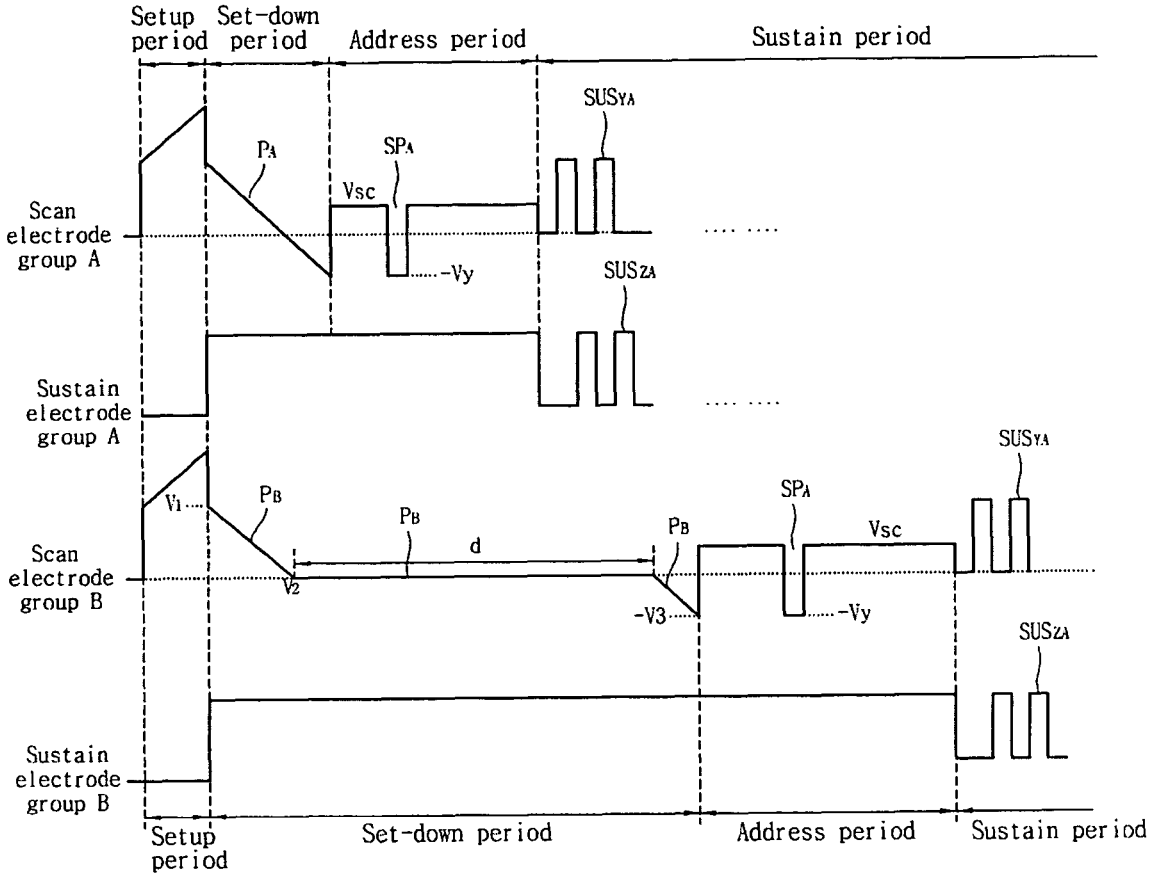
FIG. 13 illustrates a method of driving a plasma display apparatus according to a seventh embodiment.

FIG. 13 illustrates a method of driving a plasma display apparatus according to a seventh embodiment. The plasma display apparatus according to the second embodiment illustrated in FIG. 12 can supply a driving waveform illustrated in FIG. 13. In other words, the scan driver 130 supplies a set-down pulse $P_A$ with a gradually falling voltage to scan electrodes of a scan electrode group A during a set-down period. After completing the scanning of the scan electrode group A, the scan driver 130 supplies a set-down pulse $P_B$ to scan electrodes of a scan electrode group B. The set-down pulse $P_B$ gradually falls from a first voltage V1 to a second voltage V2 during a first period, is maintained at the second voltage V2 during a second period d, and gradually falls from the second voltage V2 to a third voltage V3 during a third period.

When supplying the set-down pulse $P_B$ to the scan electrodes of the scan electrode group B, the scan driver 130 sequentially supplies a scan pulse $SP_A$ to the scan electrodes of the scan electrode group A. In other words, the scan driver 130 supplies the scan pulse $SP_A$ through a scan drive integrated circuit (IC) $D_A$ connected to the scan electrode group A to the scan electrode group A, and supplies the set-down pulse $P_B$ through a scan drive IC $D_B$ connected to the scan electrode group B to the scan electrode group B. In particular, the scan driver 130 may supply the scan pulse $SP_A$ to the scan electrode group B during the second period d when the second voltage V2 is supplied. Further, the scan driver 130 may supply the scan pulse $SP_A$ and a sustain pulse $SUS_A$ to the scan electrode group B during the second period d. The first sustainer 131 of the scan driver 130 supplies a sustain pulse $SUS_{YA}$ through the scan drive IC $D_A$ connected to the scan electrode group A. The third sustainer 151 of the sustain driver 150 supplies a sustain pulse $SUS_{ZA}$ through the scan drive IC $D_B$ connected to the scan electrode group B.

After supplying the set-down pulse $P_B$ to the scan electrode group B, the scan driver 130 supplies the scan pulse $SP_B$ through the scan drive IC $D_B$ connected to the scan electrode group B to the scan electrode group B. Afterwards, the second sustainer 133 of the scan driver 130 and the fourth sustainer 153 of the sustain driver 150 supply the sustain pulses $SUS_{YB}$ and $SUS_{ZB}$ to the scan electrode group B and the sustain electrode group B.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. Moreover, unless the term "means" is explicitly recited in a limitation of the claims, such limitation is not intended to be interpreted under 35 USC 112(6).

What is claimed is:

1. A plasma display apparatus comprising:

a plasma display panel having a plurality of scan electrodes, a plurality of sustain electrodes and a plurality of address electrodes;

a driving pulse controller for outputting a timing control signal; and a driver for supplying a first set-down pulse, which gradually falls from a first voltage to a second voltage during a first period, is maintained at the second voltage during a second period, and gradually falls from the second voltage to a third voltage during a third period, to a first scan electrode of the plurality of scan electrodes depending on the timing control signal, the driver supplying a second set-down pulse that gradually falls from the first voltage to the third voltage during the first period to a second scan electrode of the plurality of scan electrodes, supplying a first scan pulse to the second scan electrode during at least one of the second period and the third period, and supplying a second scan pulse to the first electrode after the third period.

2. The plasma display apparatus of claim 1, wherein the driver sequentially supplies a scan pulse to at least two successively disposed electrodes of the plurality of electrodes.

3. The plasma display apparatus of claim 1, wherein the driver sequentially supplies a scan pulse to either odd-numbered electrodes or even-numbered electrodes of the plurality of electrodes.

4. The plasma display apparatus of claim 1, wherein the driver supplies a third set-down pulse, which gradually falls from a fourth voltage to a fifth voltage during the first period, is maintained at the fifth voltage during the second period, and gradually falls from the fifth voltage to a sixth voltage during the third period, to a third scan electrode of the plurality of scan electrodes.

5. The plasma display apparatus of claim 1, wherein the driver supplies the first set-down pulse, which gradually falls from the first voltage to the second voltage during the first period, is maintained at the second voltage during the second period, and gradually falls from the second voltage to the third voltage during the third period, to the first scan electrode of the plurality of scan electrodes in each of two different subfields, and a duration of the second period of one subfield of the two different subfields is different from a duration of the second period of the remaining subfield of the two different subfields.

6. The plasma display apparatus of claim 1, wherein a magnitude of a slope of the voltage supplied during the first period is substantially equal to a magnitude of a slope of the voltage supplied during the third period.

7. The plasma display apparatus of claim 1, wherein a magnitude of a slope of the voltage supplied during the first period is different from a magnitude of a slope of the voltage supplied during the third period.

8. The plasma display apparatus of claim 1, wherein the first voltage is greater than a ground level voltage, and the first voltage is equal to or less than a sustain voltage.

9. The plasma display apparatus of claim 1, wherein the second voltage is greater than the third voltage, and the second voltage is equal to or less than a ground level voltage.

10. The plasma display apparatus of claim 1, wherein the third voltage is equal to or greater than a lowest voltage of the scan pulses.

11. The plasma display apparatus of claim 4, wherein a duration of a period during which the first set-down pulse is maintained at the second voltage is different from a duration of a period during which the third set-down pulse is maintained at the fifth voltage.

12. The plasma display apparatus of claim 1, wherein a pause period is provided between the first scan pulse and the second scan pulse.

13. The plasma display apparatus of claim 12, wherein the pause period overlaps a portion of the third period.

14. The plasma display apparatus of claim 12, wherein the pause period ranges from 1 us to 100 us.

15. A method of driving a plasma display apparatus comprising a plurality of scan electrodes, a plurality of sustain electrodes and a plurality of address electrodes, the method comprising:

gradually decreasing a voltage of a first scan electrode of the plurality of scan electrodes from a first voltage to a second voltage during a first period of a set-down period;

maintaining a voltage of the first scan electrode at the second voltage during a second period of the set-down period;

gradually decreasing a voltage of the first scan electrode from the second voltage to a third voltage during a third period of the set-down period;

gradually decreasing a voltage of a second scan electrode of the plurality of scan electrodes from the first voltage to the third voltage during the first period of the set-down period;

supplying a first scan pulse to the first scan electrode during at least one of the second period and the third period; and supplying a second scan pulse to the second electrode after the third period.

16. The method of claim 15, further comprising:

decreasing a voltage of a third scan electrode of the plurality of scan electrodes from a fourth voltage to a fifth voltage during the first period;

maintaining a voltage of the third scan electrode at the fifth voltage during the second period; and decreasing a voltage of the third scan electrode from the fifth voltage to a sixth voltage during the third period.

17. The method of claim 15, wherein the first voltage is greater than a ground level voltage, and the first voltage is equal to or less than a sustain voltage.

18. The method of claim 15, wherein the second voltage is greater than the third voltage, and the second voltage is equal to or less than a ground level voltage.

19. The method of claim 15, wherein the third voltage is equal to or greater than a lowest voltage of the scan pulse.

* * * * *